US010032409B1

(12) United States Patent
Wu

(10) Patent No.: US 10,032,409 B1
(45) Date of Patent: Jul. 24, 2018

(54) CALIBRATION APPARATUS FOR OLED SUB-PIXEL CIRCUIT, SOURCE ELECTRODE DRIVING CIRCUIT, AND DATA VOLTAGE COMPENSATION METHOD

(71) Applicant: BOE TECHNOLOGY GROUP CO., LTD., Beijing (CN)

(72) Inventor: Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/533,478

(22) PCT Filed: Dec. 22, 2016

(86) PCT No.: PCT/CN2016/111468
§ 371 (c)(1),
(2) Date: Jun. 6, 2017

(87) PCT Pub. No.: WO2017/215229
PCT Pub. Date: Dec. 21, 2017

(30) Foreign Application Priority Data

Jun. 17, 2016 (CN) ..... 2016 1 0440604

(51) Int. Cl.
*G09G 3/3225* (2016.01)
*G09G 3/3275* (2016.01)
*G09G 1/00* (2006.01)

(52) U.S. Cl.
CPC ..... *G09G 3/3225* (2013.01); *G09G 3/3275* (2013.01); *G09G 2300/0842* (2013.01);
(Continued)

(58) Field of Classification Search
CPC ..... G09G 3/3225; G09G 3/3275; G09G 2300/0295; G09G 2320/04; G09G 2320/0693
See application file for complete search history.

(56) References Cited

U.S. PATENT DOCUMENTS 7,619,597 B2 11/2009 Nathan et al.
2013/0050292 A1 2/2013 Mizukoshi
(Continued)

FOREIGN PATENT DOCUMENTS

CN 102968954 A 3/2013
CN 104700761 A 6/2015
(Continued)

OTHER PUBLICATIONS

International Search Report & Written Opinion dated Mar. 27, 2017 regarding PCT/CN2016/111468.

*Primary Examiner* — Charles Hicks
(74) *Attorney, Agent, or Firm* — Intellectual Valley Law, P.C.

(57) ABSTRACT

The present application discloses a calibration apparatus associated with a sub-pixel circuit, a source electrode driving circuit, and a method for compensating data voltage applied to the data line of the sub-pixel circuit associated with a data line and a sense line. The calibration apparatus includes a capacitance measurement circuit to output a capacitance measurement voltage related to the sense line, a charge sensing circuit to sense a charge voltage on the sense line when the data line is applied with a reference data voltage, and a parameter calibrator to calculate parameters of driving transistor in the sub-pixel circuit based on the capacitance measurement voltage, the reference data voltage, and the charge voltage, and is configured to determine electrical parameter drifts of the driving transistor for the source electrode driving circuit to determine a compensation data voltage to compensate non-uniformity of luminance due to the electrical parameter drifts.

15 Claims, 7 Drawing Sheets

(52) U.S. Cl.
CPC . *G09G 2320/0295* (2013.01); *G09G 2320/04* (2013.01); *G09G 2320/0693* (2013.01)

(56) References Cited

U.S. PATENT DOCUMENTS

| | | | |
|---|---|---|---|
| 2015/0154908 | A1 | 6/2015 | Nam et al. |
| 2015/0379937 | A1 | 12/2015 | Kim et al. |
| 2016/0012798 | A1 | 1/2016 | Oh et al. |
| 2017/0053590 | A1 | 2/2017 | Song et al. |

FOREIGN PATENT DOCUMENTS

| | | | |
|---|---|---|---|
| CN | 104700772 | A | 6/2015 |
| CN | 105321455 | A | 2/2016 |
| CN | 105321456 | A | 2/2016 |
| CN | 106097969 | A | 11/2016 |

CALIBRATION APPARATUS FOR OLED SUB-PIXEL CIRCUIT, SOURCE ELECTRODE DRIVING CIRCUIT, AND DATA VOLTAGE COMPENSATION METHOD

CROSS-REFERENCE TO RELATED APPLICATION

This application is a national stage application under 35 U.S.C. § 371 of International Application No. PCT/CN2016/111468 filed Dec. 22, 2016, which claims priority to Chinese Patent Application No. 201610440604.7, filed Jun. 17, 2016, the contents of which are incorporated by reference in the entirety.

TECHNICAL FIELD

The present invention relates to organic light emission display technology field, and particularly to a calibration apparatus associated with each sub-pixel circuit, a source electrode driving circuit, and a data voltage compensation method used in the organic light emission display equipment.

BACKGROUND

Organic light emission diode (OLED) has been widely used as a current-source-based light emitter for high performance display equipment. Specifically, in active matrix OLED display, each row of an array of pixels is sequentially turned on by progressively scanning through row-by-row for display. A data voltage is applied to every row of pixels that is turned on, based on which an OLED current is generated to cause the diodes in the row of pixels to emit light for displaying an image controlled by the data voltage.

SUMMARY

In one aspect, the present invention provides a calibration apparatus associated with a sub-pixel circuit, wherein the sub-pixel circuit comprises a driving transistor having a gate coupled to a data line and a drain coupled to a sense line to drive a light emitter; the calibration apparatus comprises a capacitance measurement circuit coupled to a pulse voltage source, configured to charge the parasitic capacitance based on a pulse voltage provided by the pulse voltage source and to output a capacitance measurement voltage associated with the parasitic capacitance and the pulse voltage; a charge sensing circuit, configured to sense a charge voltage on the sense line in response to a reference data voltage applied to the data line; and a parameter calibrator, configured to calculate electrical parameters of the driving transistor based on the capacitance measurement voltage, the pulse voltage, the reference data voltage, and the charge voltage.

Optionally, the charge sensing circuit comprises a conductive wire and is configured to sense a first charge voltage on the sense line in response to a first reference data voltage applied to the data line, and to sense a second charge voltage on the sense line in response to a second reference data voltage applied to the data line; wherein the parameter calibrator calculates electrical parameters of the driving transistor based on the capacitance measurement voltage, the pulse voltage, the first reference data voltage, the first charge voltage, the second reference data voltage, and the second charge voltage.

Optionally, the electrical parameters include threshold voltage and carrier mobility rate.

Optionally, the capacitance measurement circuit comprises the pulse voltage source having a first terminal connected to the second power-supply terminal and a second terminal for outputting the pulse voltage; a voltage comparator having a non-inverting input terminal connected to the second terminal of the pulse voltage source, an inverting input terminal connected to the sense line, and an output terminal for outputting the capacitance measurement voltage; and a feedback circuit having a first terminal connected to the output terminal of the voltage comparator and a second terminal connected to the inverting input terminal of the voltage comparator.

Optionally, the feedback circuit comprises a first resistor and a first capacitor having a first common terminal connected to the inverting input terminal of the voltage comparator and a second common terminal connected to the output terminal of the voltage comparator; wherein a difference between the capacitance measurement voltage and the pulse voltage is proportional to the parasitic capacitance of the sense line, proportional to the pulse voltage, and inversely proportional to a capacitance of the first capacitor when a pulse rate of the pulse voltage is higher than a predetermined threshold frequency.

In another aspect, the present invention provides a source electrode driving circuit configured to generate a data voltage for each corresponding sub-pixel circuit in a pixel array, wherein the pixel array includes a plurality of sub-pixels, a plurality of first scan lines, a plurality of second scan lines, a plurality of data lines, and a plurality of sense lines, each sub-pixel comprises a sub-pixel circuit including a driving transistor, a first switching transistor, a second switching transistor, and a light emitter, wherein the sense line comprises a parasitic capacitance; the source electrode driving circuit comprising a first multiplexer configured to select each sense line in the pixel array; a capacitance measurement circuit connected to an output terminal of the first multiplexer, the capacitance measurement circuit comprising a pulse voltage source, the capacitance measurement circuit configured to charge the sense line selected by the first multiplexer based on a pulse voltage generated by the pulse voltage source and configured to output a capacitance measurement voltage associated with the pulse voltage and the parasitic capacitance of the sense line selected by the first multiplexer, a second multiplexer comprises a plurality of input lines configured to select each sense line in the pixel array and an output line configured to output a charge voltage to charge the sense line selected by the second multiplexer; and a parameter calibrator coupled to the output line of the second multiplexer and configured to calculate electrical parameters of the driving transistor in a sub-pixel circuit corresponding to the sense line selected by the second multiplexer based on the capacitance measurement voltage corresponding to the sense line selected by the second multiplexer, and based on a reference data voltage applied to the data line and the charge voltage to charge the sense line selected by the second multiplexer.

Optionally, the pixel array includes M rows and N columns of pixels, each pixel includes at least one sub-pixel, each row of sub-pixels share a first scan line and a second scan line, and each column of sub-pixels share a data line and a sense line.

Optionally, the source electrode driving circuit further comprises a third multiplexer configured to select one of the capacitance measurement voltage received from the capacitance measurement circuit to control the source electrode driving circuit to operate in a capacitance measurement mode and the charge voltage received from the second multiplexer to control the source electrode driving circuit to operate in a charge sensing mode.

Optionally, the source electrode driving circuit further comprises an analog-to-digital convertor connected to an output terminal of the third multiplexer to convert an analog signal associated with either the capacitance measurement voltage or the charge voltage to a digital signal; a data voltage compensator configured to determine a compensation data voltage for each sub-pixel circuit in the pixel array based on a given data voltage applied to the data line of the sub-pixel circuit and the electrical parameters of the driving transistor of the sub-pixel circuit obtained by the parameter calibrator, and a data voltage generator configured to generate and apply the compensation data voltage to the data line connected to the sub-pixel circuit.

Optionally, the parameter calibrator and the data voltage compensator each comprises a digital signal processor for processing the electrical parameters and the compensation data voltage in digital format.

Optionally, the data voltage generator comprises a digital-to-analog convertor configured to convert the compensation data voltage in digital format determined by the data voltage compensator to an analog signal and apply the compensation data voltage in analog format to the data line connected to the sub-pixel circuit.

Optionally, the second multiplexer is configured to output a first charge voltage corresponding to a sense line selected in order by the second multiplexer from a row of sub-pixel circuits selected from the pixel array, each data line connected to the row of sub-pixel circuits being applied with a first reference data voltage; the second multiplexer is further configured to output a second charge voltage corresponding to a sense line selected in order by the second multiplexer from a row of sub-pixel circuits selected from the pixel array, each data line connected to the row of sub-pixel circuits being applied with a second reference data voltage; and the parameter calibrator is configured to determine the electrical parameters of the driving transistor of each sub-pixel circuit in the pixel array based on the capacitance measurement voltage on the sense line connected to the sub-pixel circuit measured by the capacitance measurement circuit, the first reference data voltage applied to the corresponding data line connected to the sub-pixel circuit, the first charge voltage on the corresponding sense line connected to the sub-pixel circuit, the second reference data voltage applied to the corresponding data line, and the second charge voltage on the corresponding sense line, wherein the first reference data voltage and the second reference data voltage are applied to the corresponding data line in different time periods.

Optionally, the electrical parameters comprise threshold voltage and carrier mobility rate associated with a driving transistor in the sub-pixel circuit.

Optionally, the capacitance measurement circuit comprises the pulse voltage source having a first terminal being grounded and a second terminal outputting the pulse voltage; a voltage comparator having a non-inverting input terminal connected to the second terminal of the pulse voltage source and an inverting input terminal connected to the sense line and an output terminal outputting the capacitance measurement voltage, and a feedback circuit having a first terminal connected to the output terminal of the voltage comparator and a second terminal connected to the inverting input terminal of the voltage comparator.

Optionally, the feedback circuit comprises a first resistor and a first capacitor having a first common terminal connected to the inverting input terminal of the voltage comparator and a second common terminal connected to the output terminal of the voltage comparator; and the parameter calibrator is configured to determine the electrical parameters of the driving transistor of the sub-pixel circuit corresponding to the sense line selected by the second multiplexer based on the capacitance measurement voltage measured for the sense line by the capacitance measurement circuit and associated pulse voltage, the capacitance of the first capacitor, the reference data voltage applied to the data line connected to the sub-pixel circuit, and the charge voltage to charge the sense line.

In another aspect, the present invention provides a method for compensating data voltage applied to each data line of a selected row of sub-pixel circuits driven by a source electrode driving circuit described herein, the method comprising selecting the capacitance measurement voltage received from the capacitance measurement circuit by the third multiplexer to control the source electrode driving circuit to operate in the capacitance measurement mode, the capacitance measurement voltage being associated with the parasitic capacitance of the sense line selected by the first multiplexer; wherein the first multiplexer sequentially selects each sense line associated with the selected row of sub-pixel circuits; outputting a first reference data voltage in a first period from the digital voltage generator progressively to one data line after another and obtaining a first charge voltage for each sub-pixel circuit read from a currently charged voltage on the corresponding sense line sequentially selected by the second multiplexer for the selected row of sub-pixel circuits from the pixel array; outputting a second reference data voltage in a second period from the digital voltage generator progressively to one data line after another and obtaining a second charge voltage for each sub-pixel circuit read from a currently charged voltage on the corresponding sense line sequentially selected by the second multiplexer for the selected row of sub-pixel circuits from the pixel array; calculating electrical parameters of a driving transistor in each of the selected row of sub-pixel circuits from the pixel array by the parameter calibrator based on the capacitance measurement voltage measured for the corresponding sense line, the first charge voltage and the second charge voltage of each sub-pixel circuit associated with the corresponding sense line obtained respectively in the first time period and the second time period; and determining a compensation data voltage of the sub-pixel circuit by the data voltage compensator based on a given data voltage applied to the corresponding data line of the sub-pixel circuit and the electrical parameters of the driving transistor in the sub-pixel circuit, generating and applying the compensation data voltage to the data line connected to the sub-pixel circuit.

Optionally, outputting a first reference data voltage to each data line and obtaining a first charge voltage from each corresponding sense line further comprise connecting the sense line in the pixel array to a reference voltage terminal as the first reference data voltage being progressively outputted to each corresponding data line; disconnecting the sense line being charged by the sub-pixel circuit from the reference voltage terminal; sequentially selecting each sense line by the second multiplexer and reading a charged voltage currently on the sense line as an output; and selecting the output by the third multiplexer during the charge sensing mode and outputting the output as the first charge voltage.

Optionally, outputting a second reference data voltage to each data line and obtaining a second charge voltage from each corresponding sense line further comprise connecting the sense line in the pixel array to a reference voltage terminal as the second reference data voltage is progressively outputted to each corresponding data line; disconnecting the sense line being charged by the sub-pixel circuit from the reference voltage terminal; sequentially selecting each sense line by the second multiplexer and reading a charged voltage currently on the sense line as an output; and selecting the output by the third multiplexer during the charge sensing mode and outputting the output as the second charge voltage.

Optionally, determining a compensation data voltage of the sub-pixel circuit comprises processing digital signals associated with the given data voltage applied to the data line of the sub-pixel circuit and corresponding electrical parameters of the driving transistor in the sub-pixel circuit to calculate a digital voltage signal, converting the digital voltage signal to an analog voltage signal by the data voltage generator, outputting the analog voltage signal as a compensation data voltage to the data line of the sub-pixel circuit.

Optionally, the electrical parameters of the driving transistor include threshold voltage and carrier mobility rate associated with the driving transistor in the sub-pixel circuit.

BRIEF DESCRIPTION OF THE FIGURES

The following drawings are merely examples for illustrative purposes according to various disclosed embodiments and are not intended to limit the scope of the present invention.

DETAILED DESCRIPTION

Figure 1:
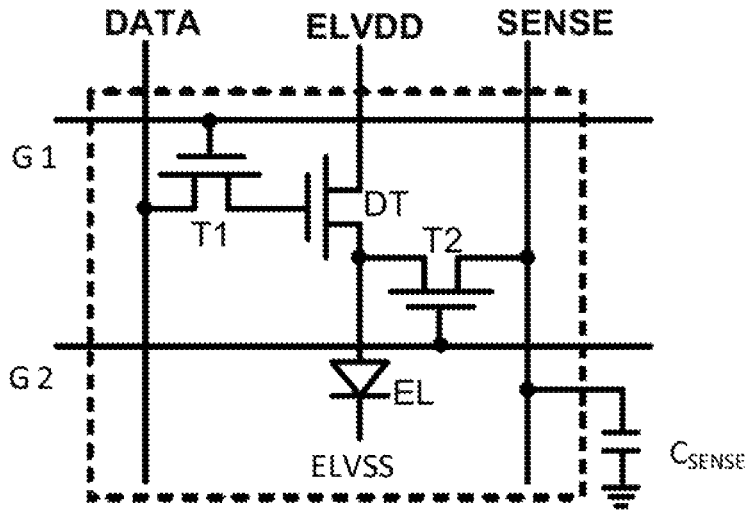
FIG. 1 is a sub-pixel circuit associated with a calibration apparatus according to an embodiment of the present invention.

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Active matrix OLED display apparatus usually adopt low-temperature poly-silicon (LTPS) thin-film transistor (TFT) or oxide TFT to construct each sub-pixel circuit for providing the OLED current. Comparing to typical amorphous silicon TFT, the LTPS TFT or Oxide TFT is more suitable for the AMOLED display due to its characteristics on a higher carrier mobility rate and superior stability. Because of limitation in crystallization process for manufacturing a plurality of LTPS TFTs on a large glass substrate, several electrical parameters such as threshold voltage and carrier mobility rate are not uniform among the TFTs. If a same data voltage is applied, the non-uniformity in carrier mobility rates or threshold voltages can result in variances of OLED current and luminance which can be perceived by human eyes. Alternatively, for Oxide TFT, its threshold voltage will drift like the amorphous silicon TFT after the data voltage is applied for a substantial long time or during a high-temperature environment even though the manufacturing process for the Oxide TFTs is more uniform over a large area. For different display images, the threshold voltages of different Oxide TFTs in different portions of the AMOLED display panel also drift different amounts. Thus, as a same data voltage is applied, different drifts of threshold voltage in different Oxide TFTs will cause different OLED currents in different sub-pixels, resulting in non-uniform brightness at different parts of the AMOLED display.

Additionally, in large size AMOLED display application, because of different distances between different sub-pixel circuits relative to data voltage output port of a source electrode driving circuit and resistance of the data line that connects the sub-pixel circuits to the source electrode driving circuit, the actual data voltages at different sub-pixel circuits also vary and are different from the original data voltage provided by the source electrode driving circuit. Similarly, power supply voltages (ARVDD) applied to the different sub-pixel circuits also vary and are different from the original power supply voltage at an output of the power supply source. Given a same data voltage outputted from the source electrode driving circuit, different data voltages and power supply voltages at different sub-pixel circuits also cause different OLED current and luminance at different part of the large size display panel. Therefore, it is desirable to have a source electrode driving circuit including a calibration apparatus to compensate non-uniformity of OLED sub-pixel circuit currents caused by a variety of non-uniformity in AMOLED display devices.

Accordingly, the present invention provides, inter alia, a calibration apparatus associated with each sub-pixel circuit, a source electrode driving circuit, and a data voltage compensation method used in the organic light emission display equipment that substantially obviate one or more of the problems due to limitations and disadvantages of the related art. In one aspect, the present disclosure provides a calibration apparatus associated with a sub-pixel circuit in an AMOLED display panel, wherein the sub-pixel circuit includes a driving transistor, a first switching transistor, a second switching transistor, and a light emitter, the first switching transistor having a gate connected to a first scan line, a first terminal and a second terminal respectively connected to a data line and a gate of the driving transistor, the second switching transistor having a gate connected to a second scan line, a first terminal and a second terminal respectively connected to a sense line and a second terminal of the driving transistor, the driving transistor also having a first terminal connected to a first power supply terminal, the light emitter having an anode and a cathode respectively connected to the second terminal of the driving transistor and a second power supply terminal, the sense line includes a parasitic capacitance. In some embodiments, the calibration apparatus includes a capacitance measurement circuit coupled to a pulse voltage source, configured to charge the parasitic capacitance based on a pulse voltage provided by the pulse voltage source and to output a capacitance measurement voltage associated with the parasitic capacitance and the pulse voltage; a charge sensing circuit, configured to sense a charge voltage on the sense line in response to a reference data voltage applied to the data line; and a parameter calibrator, configured to calculate electrical parameters of the driving transistor based on the capacitance measurement voltage, the pulse voltage, the reference data voltage, and the charge voltage.

FIG. 1 is a sub-pixel circuit associated with a calibration device according to an embodiment of the present invention. A calibration device for providing compensation data voltage for overcoming non-uniformity issue is configured to be associated with the sub-pixel circuit of FIG. 1 of an AMOLED display. As shown, the sub-pixel circuit is constructed using N-type TFT transistors, including a driving transistor DT, a first switching transistor T1, a second switching transistor T2, and a light emitter EL.

Referring to FIG. 1, the first switching transistor T1 has a first terminal connected to a data line DATA. The second switching transistor has a second terminal connected to a gate of the driving transistor DT. The gate of the first switching transistor T1 is connected to a first scan line G1. The driving transistor DT has a first terminal connected to a first power supply terminal ELVDD. Optionally, the ELVDD is a high voltage terminal. The driving transistor DT has a second terminal connected to an anode of the light emitter EL which has a cathode connected to a second power supply terminal ELVSS. Optionally, the ELVSS is a low voltage terminal. Optionally, the ELVSS is grounded. The second switching transistor T2 has a first terminal connected to the second terminal of the driving transistor DT, and a second terminal connected to a sense line SENSE. The second switching transistor T2 has also a gate connected to a second scan line G2. Referring to FIG. 1, the sense line SENSE includes a parasitic capacitance $C_{SENSE}$ forming a sense-line capacitor.

Figure 2:
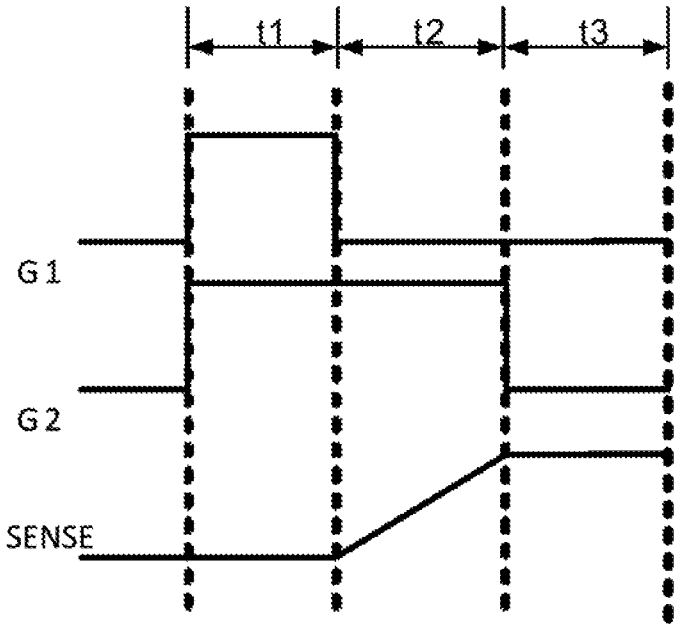
FIG. 2 is a schematic timing waveform associated with the sub-pixel circuit of FIG. 1 according to an embodiment of the present invention.

FIG. 2 is a schematic timing waveform associated with the sub-pixel circuit of FIG. 1 according to an embodiment of the present invention. The timing waveform shows how the sub-pixel circuit is operated as one unit of an AMOLED display. Referring to FIG. 2, in a first time period t1 (reset time-period), the first scan line G1 is provided with a high voltage level and the second scan line G2 also is provided with a high voltage level. The data line DATA is given by a data voltage $V_g$. The sense line SENSE is connected to a reference voltage terminal provided with $V_{ref}$. High voltage level allows the first switching transistor T1 in a conduction state to apply the data voltage $V_g$ to the gate of the driving transistor DT and also allows the second switching transistor T2 in a conduction state to connect the second terminal of the driving transistor DT to the reference voltage terminal. During this first time period t1, a gate-to-source voltage of the driving transistor DT is $V_g-V_{ref}$. Optionally, the reference voltage terminal can be connected to ELVSS, or grounded, or any other low voltage terminal.

Referring to FIG. 2, in a second time period t2 (sense time-period), the first scan line G1 is at a low voltage level and the second scan line G2 is at a high voltage level. The sense line SENSE is disconnected from the reference voltage terminal. The first switching transistor T1 is in a blocking state due to low voltage level at G1 and the second switching transistor T2 remains in the conduction state due to high voltage level at G2. At the beginning of t2, gate-to-source voltage of the driving transistor is $V_g-V_{ref}$. A driving current $i_{DT}$ that passes through the driving transistor DT can be represented by $$i_{DT}=k(V_g-V_{ref}-V_{th})^2, \tag{1}$$

where $V_{th}$ is threshold voltage of the driving transistor DT and k is coefficient proportional to a carrier mobility rate of the driving transistor. During the second time period t2, the sense-line capacitor is charged by the driving current $i_{DT}$, which makes the voltage on the sense line (i.e., the voltage at the second terminal of the driving transistor DT) to be $V_{ref}+i_{DT}\times\Delta t/C_{SENSE}$. Assuming that the voltage change on the sense line $i_{DT}\times\Delta t/C_{SENSE}$ is substantially smaller than the data voltage $V_g$ so that the change of driving current $i_{DT}$ is limited to a certain range, e.g., 0-20%. Then, at the end of t2, the voltage on the sense line can be proximately represented by $$V_{SENSE}=V_{ref}+i_{DT}\times\Delta t/C_{SENSE}=V_{ref}+k(V_g-V_{ref}-V_{th})^2+t2/C_{SENSE}, \tag{2}$$

where t2 is a time span of the second time period.

Assuming that the parasitic capacitance $C_{SENSE}$ is known, the formula (2) above can be used to determine the drifts of electrical parameters, such as threshold voltage $V_{th}$ and a carrier mobility rate, of the driving transistor DT. However, due to process non-uniformity of the AMOLED display, the parasitic capacitance associated with each sense line is different and has to be determined individually.

In an embodiment, the parasitic capacitance of a sense line is firstly measured before the electrical parameter drift of the driving transistor in a corresponding sub-pixel circuit connected to the sense line. On the other hand, the measurement of the parasitic capacitance on the sense line does not have to be performed directly to obtain a capacitance value, instead, an alternative electrical parameter that reflects the capacitance value can be measured. For example, a voltage level on the sense-line capacitor can be measured.

Figure 3:
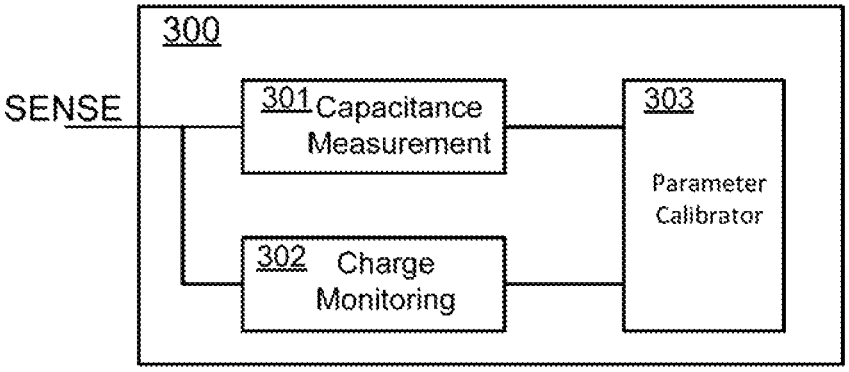
FIG. 3 is a block diagram of a calibration apparatus in a sub-pixel circuit according to an embodiment of the present invention.

FIG. 3 is a block diagram of a calibration apparatus in a sub-pixel circuit according to an embodiment of the present invention. The calibration apparatus is provided to be associated with the above sub-pixel circuit for providing data voltage compensation to at least partially compensate the e drifts of electrical parameters of the driving transistor in the sub-pixel circuit. Referring to FIG. 3, the calibration apparatus 300 associated with the sub-pixel circuit includes a capacitance measurement circuit 301, a charge sensing circuit 302, and a parameter calibrator 303.

The capacitance measurement circuit 301 is configured to charge the sense-line capacitor using a pulse voltage provided by a pulse voltage source and to output a capacitance measurement voltage associated with the capacitance of the sense-line capacitor and the pulse voltage.

The charge sensing circuit 302 is configured to sense a currently charged voltage on the sense-line capacitor under a condition that a reference data voltage is applied to the corresponding data line of a same sub-pixel circuit. Optionally, the charge sensing circuit 302 can be a conductive wire to directly pass the charged voltage from the sense-line capacitor to the parameter calibrator 303.

The parameter calibrator 303 is configured to calculate electrical parameters of the driving transistor of the sub-pixel circuit based on the capacitance measurement voltage, the pulse voltage, the reference data voltage, and the charge voltage mentioned all above. The electrical parameters of the driving transistor include threshold voltage and carrier mobility rate.

Figure 4A:
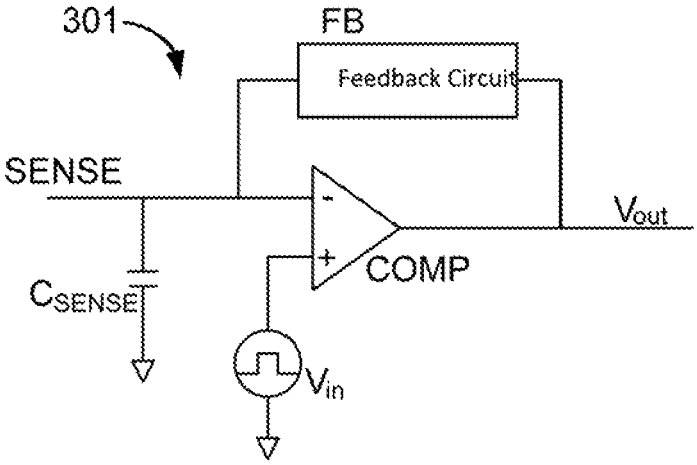
FIG. 4A is a block diagram of a capacitance measurement circuit in the calibration apparatus according to an embodiment of the present invention.

FIG. 4A is a block diagram of a capacitance measurement circuit in the calibration apparatus according to an embodiment of the present invention. Referring to the FIG. 4A, the capacitance measurement circuit 301 includes a pulse voltage source, a voltage comparator COMP, and a feedback circuit FB. The pulse voltage source has a first terminal connected to ground and a second terminal for outputting a pulse voltage Vin. The voltage comparator COMP has a non-inverting input terminal connected to the second terminal of the pulse voltage source and an inverting input terminal connected to the sense line SENSE. The feedback circuit FB has a first terminal connected to an output terminal of the voltage comparator COMP and a second terminal connected to the inverting input terminal of the voltage comparator COMP.

Figure 4B:
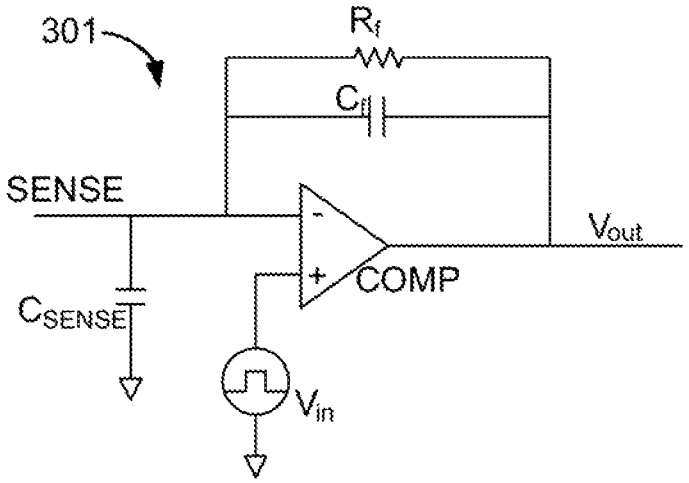
FIG. 4B is a circuitry diagram of the capacitance measurement circuit according to an embodiment of the present invention.

In a specific embodiment, as in a circuitry diagram shown in FIG. 4B, the feedback circuit FB includes a first resistor $R_f$ and a first capacitor $C_f$ connected in parallel. A first terminal of the first resistor $R_f$ and a first terminal of the first capacitor $C_f$ are commonly connected to the inverting input terminal of the voltage comparator COMP. A second terminal of the first resistor $R_f$ and a second terminal of the second capacitor $C_f$ are commonly connected to the output terminal of the voltage comparator COMP.

The configuration of circuitry connection associated with the first resistor $R_f$, the first capacitor $C_f$, and the voltage comparator COMP forms a high-pass filter for effectively filtering out low-frequency noise.

Referring to FIG. 4B, in the circuitry diagram no current passes through the inverting input terminal and the non-inverting input terminal. Thus, the current passing the sense-line capacitor $C_{SENSE}$ is the same as the current passing the feedback circuit FB. The sense-line capacitor $C_{SENSE}$ is charged to a voltage level equal to the pulse voltage Vin. A relationship between the pulse voltage Vin and an output voltage Vout of the voltage comparator COMP can be represented by following formula:

$$Vin\times(j\omega C_{SENSE})=(Vout-Vin)\times(j\omega R_f C_f+1)/R_f, \quad (3)$$

$$Vout=Vin(1+j\omega R_f C_{SENSE}/(j\omega R_f C_f+1)) \quad (4)$$

Where $j\omega C_{SENSE}$ is impedance of the sense-line capacitor, $\omega=2\pi f$, f is a base frequency of the pulse voltage Vin, and j is Imaginary unit.

When the base frequency f of the pulse voltage Vin is sufficiently high, for example, higher than a predetermined threshold frequency, the formula (4) can be proximately rewritten into:

$$Vout=Vin(1+j\omega R_f C_{SENSE}/(j\omega R_f C_f))=Vin(1+C_{SENSE}/C_f) \quad (5)$$

This is simplified as:

$$Vout-Vin=Vin\times C_{SENSE}/C_f \quad (6)$$

$$C_{SENSE}=C_f(Vout/Cin-1) \quad (7)$$

As seen in the formula (6), when the frequency of the pulse voltage is higher than the threshold frequency, the difference between the capacitance measurement voltage Vout outputted at the output terminal of the voltage comparator COMP and the pulse voltage Vin is proportional to the parasitic capacitance $C_{SENSE}$ of the sense line, proportional to the pulse voltage Vin, and inversely proportional to the capacitance $C_f$ of the first capacitor.

As seen in the formula (7), when the frequency of the pulse voltage is higher than the threshold frequency, the parasitic capacitance $C_{SENSE}$ can be calculated based on the capacitance value $C_f$ of the first capacitor and a ratio of the capacitance measurement voltage Vout at the output terminal of the voltage comparator COMP and the pulse voltage Vin.

In some embodiments, after determining the sense-line capacitance $C_{SENSE}$, the electrical parameters (with corresponding drifts) of the driving transistor DT can be determined using the following relationship as shown in FIG. 1 and FIG. 2:

$$V_{SENSE}=V_{ref}+k(V_g-V_{ref}-V_{th})^2\times t2/C_{SENSE} \quad (8)$$

In a specific embodiment, after determining the value of the sense-line capacitance $C_{SENSE}$, the charge sensing circuit 302 senses a first charge voltage $V_{S1}$ on the sense line SENSE when the corresponding data line DATA is applied with a first reference data voltage $V_{g1}$. Further in a different time period, the charge sensing circuit 302 senses a second charge voltage $V_{S2}$ on the sense line SENSE when the corresponding data line DATA is applied with a second reference data voltage $V_{g2}$.

Particularly in the embodiment, referring to FIG. 1 and FIG. 2, in a first time period (a first rest period), the first scan line G1 is at a high voltage level and the second scan line G2 is also at a high voltage level. Data line DATA is applied with $V_{g1}$. Sense line SENSE is connected to a reference voltage terminal. The first switching transistor T1 in conduction state passes the data voltage $V_{g1}$ to the gate of the driving transistor DT. The second switching transistor T2 in conduction state passes the reference voltage $V_{ref}$ from the sense line SENSE to the second terminal of the driving transistor DT. Thus, the gate-source voltage of the driving transistor DT is $V_{g1}-V_{ref}$. In a second time period (a first sensing period), the first scan line G1 is at low voltage level and the second scan line G2 is at high voltage level. The sense line SENSE is disconnected from the reference voltage terminal. The first switching transistor T1 is in blocking state and the second switching transistor T2 is in conduction state so that the parasitic sense-line capacitor $C_{SENSE}$ is charged by a voltage passed from the first power supply terminal ELVDD and the driving transistor DT. In a third time period (a first read-out period), the first scan line G1 is at low voltage level and the second scan line G2 is also at the low voltage level. The sense line remains disconnected from the reference voltage terminal. The charge sensing circuit 302 reads out a currently charged voltage (i.e., charge voltage on the sense-line capacitor) as a first charge voltage $V_{S1}$.

Referring to FIG. 1 and FIG. 2 again, in a fourth time period (a second reset period, which is substantially the same period of t1 shown in FIG. 2), the first scan line G1 is at high voltage level and the second scan line G2 is also at high voltage level. The data line DATA is given a data voltage $V_{g2}$. The sense line SENSE is connected to a reference voltage terminal $V_{ref}$. The first switching transistor T1 in conduction state allows the data voltage $V_{g2}$ to be applied to the gate of the driving transistor DT. The second switching transistor T2 in conduction state allows the reference voltage $V_{ref}$ to be applied to the second terminal of the driving transistor DT, making the gate-source voltage of DT to be $V_{g2}-V_{ref}$. In a fifth time period (a second sensing period), the first scan line G1 is at low voltage level and the second scan line G2 is at high voltage level. The sense line SENSE is disconnected from the reference voltage terminal. The first switching transistor T1 is in blocking state and the second switching transistor T2 is in conduction state. The sense-line capacitor $C_{SENSE}$ is charged by a voltage passed from the first power supply voltage terminal ELVDD and the driving transistor DT. In a sixth time period (a second read-out period), both the first scan line G1 and the second scan line G2 are at low voltage level. The sense line SENSE remains disconnected from the reference voltage terminal. The charge sensing circuit 302 reads out currently charged voltage (i.e., charge voltage on the sense-line capacitor) as a first charge voltage $V_{S2}$.

Accordingly, the parameter calibrator 303 is able to calculate the electrical parameters of the driving transistor DT based on the capacitance measurement voltage Vout, the pulse voltage Vin, the first reference data voltage $V_{g1}$, the first charge voltage $V_{S1}$, the second reference data voltage $V_{g2}$, the second charge voltage $V_{S2}$.

Optionally, the parameter calibrator 303 determines the capacitance value of the sense-line capacitor $C_{SENSE}$ based on the capacitance measurement voltage outputted by the capacitance measurement circuit 301 and the pulse voltage Vin received by the capacitance measurement circuit 301. Then, the parameter calibrator 303 can calculate the electrical parameters of the driving transistor DT using the capacitance of the sense-line capacitor, the first reference data voltage $V_{g1}$, the first charge voltage $V_{S1}$, the second reference data voltage $V_{g2}$, and the second charge voltage $V_{S2}$. Particularly, electrical parameters like the threshold voltage and carrier mobility rate of the driving transistor DT are obtained.

Optionally, the fourth time period mentioned above can be set right after the third time period. Optionally, between the fourth time period and the third time period there can be at least one of other time periods mentioned above.

In an alternative embodiment, after the capacitance measurement voltage Vout is measured or after the sense line capacitance $C_{SENSE}$ is determined, the charge sensing circuit 302 senses a first charge voltage $V_{S1}$ on the sense line SENSE after a sensing time period of t2 under a condition that the corresponding data line DATA is applied with a first reference data voltage $V_{g1}$. Further, the charge sensing circuit 302 senses a second charge voltage $V_{S2}$ on the sense line SENSE after a sensing time period of (t2+t4) under a condition that the corresponding data line DATA is applied with the first reference data voltage $V_{g1}$.

Particularly in the embodiment, referring to FIG. 1 and FIG. 2, in a first time period (a first rest period), the first scan line G1 is at a high voltage level and the second scan line G2 is also at a high voltage level. Data line DATA is applied with $V_{g1}$. Sense line SENSE is connected to a reference voltage terminal. The first switching transistor T1 in conduction state passes the data voltage $V_{g1}$ to the gate of the driving transistor DT. The second switching transistor T2 in conduction state passes the reference voltage $V_{ref}$ from the sense line SENSE to the second terminal of the driving transistor DT. Thus, the gate-source voltage of the driving transistor DT is $V_{g1}-V_{ref}$. In a second time period (a first sensing period), the first scan line G1 is at low voltage level and the second scan line G2 is at high voltage level. The sense line SENSE is disconnected from the reference voltage terminal. The first switching transistor T1 is in blocking state and the second switching transistor T2 is in conduction state so that the parasitic sense-line capacitor $C_{SENSE}$ is charged by a voltage passed from the first power supply terminal ELVDD and the driving transistor DT. In a third time period (a first read-out period), the first scan line G1 is at low voltage level and the second scan line G2 is also at the low voltage level. The sense line remains disconnected from the reference voltage terminal. The charge sensing circuit 302 reads out a currently charged voltage (i.e., charge voltage on the sense-line capacitor) as a first charge voltage $V_{S1}$.

Referring to FIG. 1 and FIG. 2 again, in a fourth time period (a second sensing period), the first scan line G1 is at low voltage level and the second scan line G2 is at high voltage level. The sense line SENSE is disconnected from the reference voltage terminal. The first switching transistor T1 is in blocking state and the second switching transistor T2 is in conduction state. Thus, the sense-line capacitor $C_{SENSE}$ is charged by a voltage passed from the first power supply terminal ELVDD and the driving transistor DT. For example, the fourth time period includes a time span of t4 which can be equal to or different from a time span t2 associated the second time period (i.e., the first sensing period mentioned above). In a fifth time period (a second read-out period), the first scan line G1 is at low voltage level and the second scan line G2 is at low voltage level. The sense line SENSE remains disconnected from the reference voltage terminal. The charge sensing circuit 302 reads out a charged voltage on the sense-capacitor as a second charge voltage $V_{S2}$.

Accordingly, the parameter calibrator 303 is able to calculate the electrical parameters of the driving transistor DT based on the capacitance measurement voltage Vout (or the capacitance of the sense-line capacitor $C_{SENSE}$), the first reference data voltage $V_{g1}$, the time span t2 over the second time period, the first charge voltage $V_{S1}$, the time span t4 over the fourth time period, and the second charge voltage $V_{S2}$. For example, the threshold voltage and the carrier mobility rate of the driving transistor DT are obtained.

Figure 5:
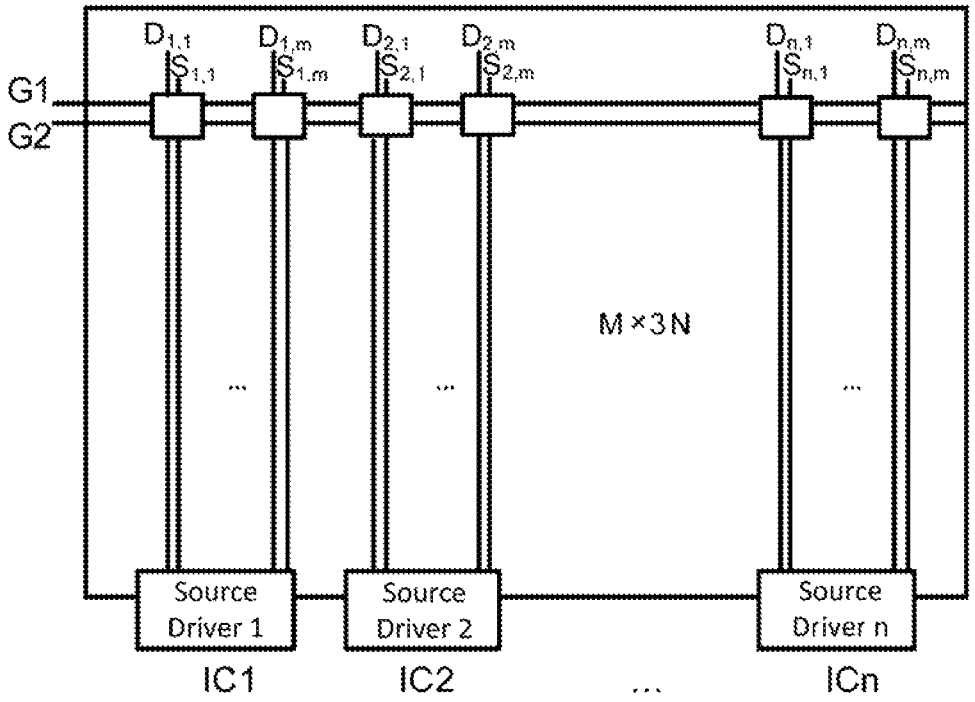
FIG. 5 is a schematic diagram of an AMOLED display panel according to an embodiment of the present invention.

FIG. 5 is a schematic diagram of an AMOLED display panel according to an embodiment of the present invention. Referring to FIG. 5, the AMOLED display panel includes a pixel array having M rows and N columns of pixels. Each pixel includes at least one sub-pixel. Each row of sub-pixels shares a first scan line and a second scan line. Each column of sub-pixels shares a data line and a sense line.

As an example, assuming each pixel includes three sub-pixels, there are n numbers of source electrode driving circuits for providing data voltages to the pixel array of the AMOLED display panel. Each source electrode driving circuit includes m data lines and m sense lines. Here 3N=m×n. m and n are integers greater than 1. In the following sections of the specification, only one source electrode driving circuit, i.e., n=1, is selected to provide data voltages for the pixel array of the display panel. Of course, the invention is not limited by this selection.

Figure 6A:
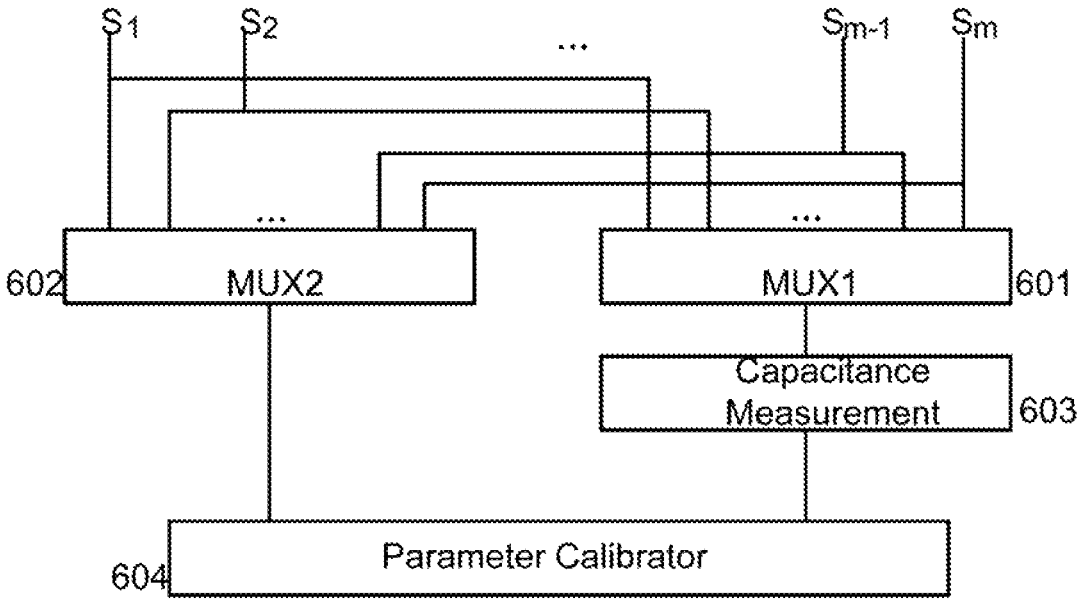
FIG. 6A is a schematic diagram of a source electrode driving circuit according to an embodiment of the present invention.

FIG. 6A is a schematic diagram of a source electrode driving circuit according to an embodiment of the present invention. Referring to FIG. 6A, the source electrode driving circuit includes a first multiplexer (MUX1) 601, a second multiplexer (MUX2) 602, a capacitance measurement circuit 603, and a parameter calibrator 604.

The first multiplexer 601 has m selective input ports respectively connected to m sense lines and is configured to progressively select each sense line in the pixel array, such as S1, S2, . . . , Sm−1, and Sm.

The capacitance measurement circuit 603 is connected to an output port of the first multiplexer 601 and connects a pulse voltage source to use a pulse voltage to charge any one sense line selected by the first multiplexer 601 and output a capacitance measurement voltage associated with the pulse voltage and the capacitance value of the sense line selected by the selected by the first multiplexer 601. The capacitance measurement circuit 603 can be substantially the same as the capacitance measurement circuit 301 as shown in FIG. 3.

For any sense line selected by the first multiplexer 601, the parameter calibrator 604 can determine a capacitance value of the sense-line capacitor associated with the selected sense line based on the capacitance measurement voltage and the pulse voltage. In particular, as shown in FIG. 4B, the parameter calibrator 604 can determine the capacitance value of the sense-line capacitor based on the capacitance measurement voltage Vout on the selected sense line, the pulse voltage Vin, and the feedback capacitor $C_f$.

The second multiplexer (MUX2) 602 has m selective input ports respectively connected to m sense lines. MUX2 is configured to progressively select each sense line of S1, S2, . . . , Sm−1, and Sm in the pixel array and output a charge voltage on the selected sense line.

The parameter calibrator 604 also connects an output port of the MUX2. For each sense line selected by the MUX2, the parameter calibrator 604 can calculate electrical parameters of the driving transistor of a currently selected sub-pixel circuit associated with the currently selected sense line. The calculation is based on the capacitance measurement voltage (or the sense-line capacitance) of the selected sense line, a reference data voltage applied to the corresponding data line (associated with the same selected sub-pixel circuit), and the charge voltage on the selected sense line by MUX2. For example, electrical parameters like threshold voltage and carrier mobility rate of the driving transistor are obtained.

Figure 6B:
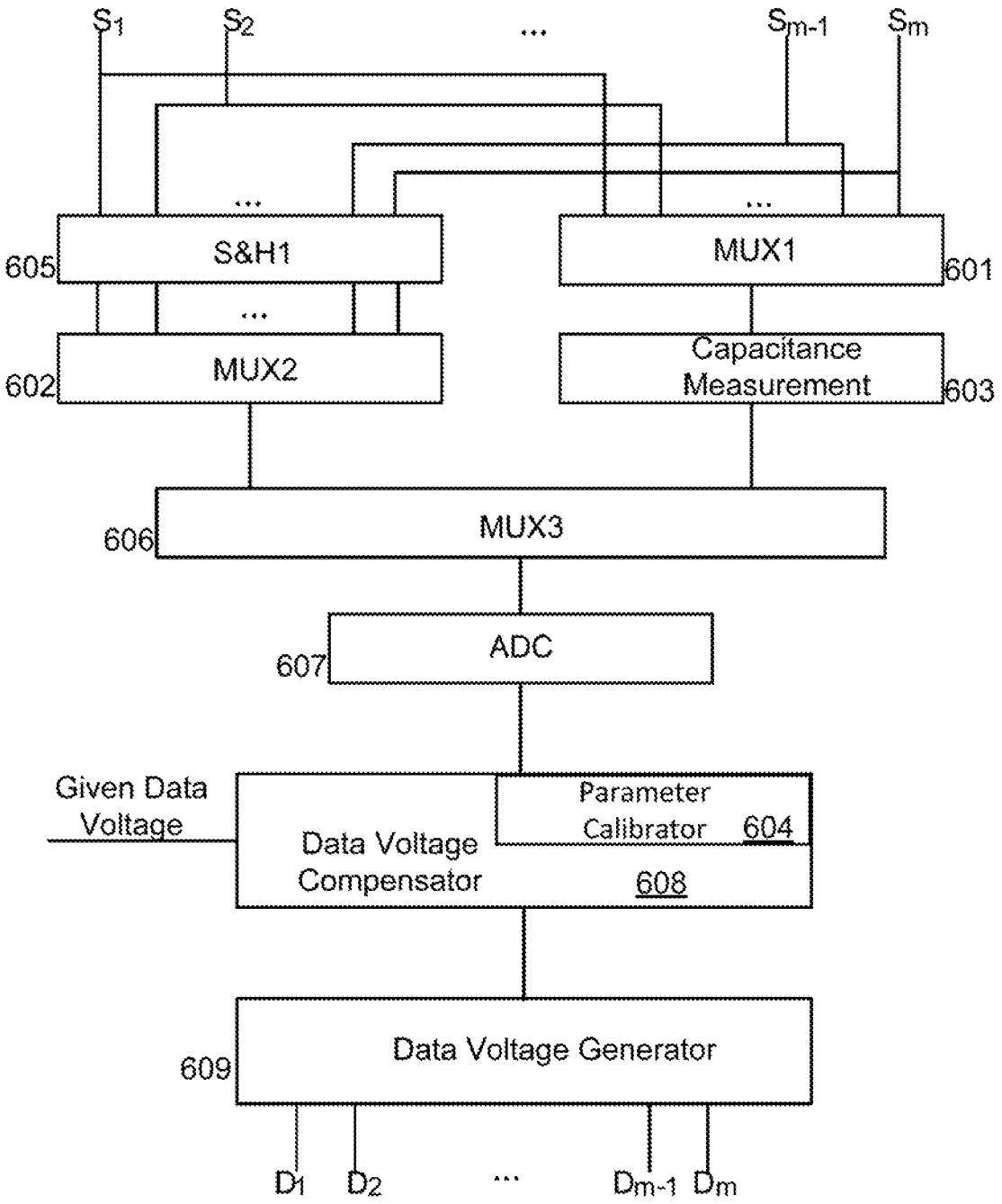
FIG. 6B is a schematic diagram of another source electrode driving circuit according to another embodiment of the present invention.

FIG. 6B is a schematic diagram of another source electrode driving circuit according to another embodiment of the present invention. The source electrode driving circuit also includes a third multiplexer (MUX3) 606, an analog-to-digital converter (ADC) 607, a data voltage compensator 608, and a data voltage generator 609. Two selective inputs of MUX3 606 respectively are connected to an output of the MUX2 602 and an output of the capacitance measurement circuit 603. The MUX3 606 is configured to select either a charge voltage outputted by the MUX2 602 to control the source electrode driving circuit to operate in a charge sensing mode or a capacitance measurement voltage outputted by the capacitance measurement circuit 603 to control the source electrode driving circuit to operate in a capacitance measurement mode. Two selective inputs of MUX3 606 respectively are connected to an output of the MUX2 602 and an output of the capacitance measurement circuit 603. During the capacitance measurement mode, an output of the MUX3 606 outputs the capacitance measurement voltage outputted by the capacitance measurement circuit 603. During the charge sensing mode, the output of MUX3 606 outputs the charge voltage outputted by the MUX2 602.

The analog-to-digital converter 607 has an input terminal connected to the output of the MUX3 to convert analog signals received at the output of MUX3 606 into digital signals. Particularly, when the MUX3 606 selects the capacitance measurement voltage from the output of the capacitance measurement circuit with the source electrode driving circuit in a capacitance measurement mode, the analog-to-digital converter 607 receives a capacitance measurement voltage from the MUX 606 which is outputted from the capacitance measurement circuit 603 and converts this capacitance measurement voltage into a signal in digital format. When the MUX3 606 selects the charge voltage from the output of the second multiplexer with the source electrode driving circuit in a charge sensing mode, the ADC 607 receives a charge voltage from the MUX 606 which is outputted from the MUX2 602 and converts this charge voltage into a digital signal.

For each sub-pixel circuit in the pixel array of the AMOLED display panel, the data voltage compensator 608 is configured to calculate a compensation data voltage associated with the sub-pixel circuit based on a given data voltage on the data line and relevant electrical parameters of the corresponding driving transistor of the sub-pixel circuit determined by the parameter calibrator 604. The parameter calibrator 604 and the data voltage compensator 608 are respectively configured using digital signal processors. Thus, the data voltage compensator 608 is able to output a compensation data voltage as an output signal in digital format.

Referring to FIG. 6B, the data voltage generator 609 has m output terminals respectively connected to m data lines D1, D2, . . . , Dm−1, and Dm to output corresponding data voltages. For each sub-pixel circuit in the pixel array, the data voltage generator 609 is configured to generate a compensation data voltage based on the compensation data voltage calculated by the data voltage compensator 608, and further apply the compensation data voltage to the corresponding data line connected to the sub-pixel circuit.

Next, a single sub-pixel circuit is used as an example to describe operations of the parameter calibrator 604 for handling digital signal format. The ADC 607 converts an input analog voltage into an n-bit digital signal. Particularly, the ADC 607 has a conversion base voltage Vbase. When the input analog voltage equals to the Vbase, the n-bits of the digital signal outputted by the ADC 607 are all 1. For a capacitance measurement voltage Vout, the ADC 607 converts the inputted capacitance measurement voltage Vout into an n-bit digital signal Evc. Thus, a relationship between the capacitance measurement voltage Vout and the digital signal Evc can be represented by the following formula:

$$V\text{out}=V\text{base}\times Evc/2^n \tag{9}$$

Correspondingly, formula (7) can rewritten as:

$$C_{SENSE}=C_f(V\text{base}/V\text{in}\times Evc/2^n-1) \tag{10}$$

On the other hand, for the charge voltage $V_{SENSE}$ on the sense-line capacitor, the ADC 607 converts the inputted charge voltage $V_{SENSE}$ to an n-bit digital signal Evs. Thus, a relationship between the charge voltage $V_{SENSE}$ and the digital signal Evs can be represented by the following formula:

$$V_{SENSE}=V\text{base}\times Evs/2^n \tag{11}$$

Combining the formulas (11) and (2), $$V\text{base}\times Evs/2^n=V_{ref}+k(V_g-V_{ref}-V_{th})^2\times t2/C_{SENSE}$$

$$Evs=(V_{ref}+k(V_g-V_{ref}-V_{th})^2\times t2/C_{SENSE})/V\text{base}\times 2^n \tag{12}$$

For simplifying the equation above, the reference voltage $V_{ref}$ is assumed to be 0, the following formula is obtained:

$$Evs=2^n\times k(V_g-V_{th})^2\times t2/(C_{SENSE}\times V\text{base}) \tag{13}$$

Substituting the formula (10) into the formula (13), $$\begin{aligned} k(V_g-V_{th})^2 &= ((Evs\times Vbase)/(2^n\times t2))\times \\ &\quad (C_f\times Vbase/Vin\times Evc/2^n-1)) \\ &= Evs\times(Vbase/(2^n\times t2))\times \\ &\quad (C_f\times Vbase/(Vin\times 2^n)\times Evc-1)) \\ &= Evs\times k1\times(k2\times Evc-1) \end{aligned} \tag{14}$$

where k1=Vbase/($2^n$×t2), k2=$C_f$×Vbase/(Vin×$2^n$). For a specific capacitance measurement circuit 603, a sub-pixel circuit, and an ADC 607, k1 and k2 are constants.

As describe in earlier sections of the specification, under a condition that the first reference data voltage $V_{g1}$ is applied to the data line, the charge sensing circuit 302 senses a first charge voltage $V_{SENSE1}$ on the corresponding sense line. Similarly, under another condition that the first reference data voltage $V_{g2}$ is applied to the data line, the charge sensing circuit 302 senses a first charge voltage $V_{SENSE2}$ on the corresponding sense line. Therefore, one can deduce the following equations:

$$k(V_{g1}-V_{th})^2=Evs1\times k1\times(k2\times Evc-1)$$

$$k(V_{g2}-V_{th})^2=Evs2\times k1\times(k2\times Evc-1) \quad (15)$$

For each sense line in the pixel array, after the ADC 607 converts the capacitance measurement voltage generated by the capacitance measurement circuit 603 into a digital signal Evc, it can store the digital signal Evc only and no need to calculate the capacitance associated with the sense line based on the digital signal Evc. Additionally, for each sub-pixel circuit, after obtaining digital signals Evs1 and Evs2 respectively corresponding to a first charge voltage and a second charge voltage, the parameter calibrator 604 can directly calculate relevant electrical parameters of the corresponding driving transistor of the sub-pixel circuit based on the digital signal Evc associated with the sense line corresponding to the sub-pixel circuit, and the digital signals Evs1 and Evs2. For example, threshold voltage and carrier mobility rate of the driving transistor can be calculated using the above method.

Further referring to FIG. 6B, the source electrode driving circuit also includes a first sample-and-hold circuit (S&H1) 605 having m sample-&-hold channels. Each sample-&-hold channel has an input and an output. The S&H1 1605 has m inputs respectively connected to m sense lines S1, S2, . . . , Sm−1, and Sm, and m outputs respectively connected to m selective input ports of the second multiplexer MUX2.

In some embodiments, the parameter calibrator 303 in FIG. 3 can include the analog-to-digital converter 607 and parameter calibrator 604 in FIG. 6B. In some embodiments, the charge sensing circuit 302 in FIG. 3 can include one channel of the sample-and-hold circuit 605, one selective channel of the second multiplexer MUX2 602, and one selective channel of the third multiplexer MUX3 606 in FIG. 6B.

Figure 7:
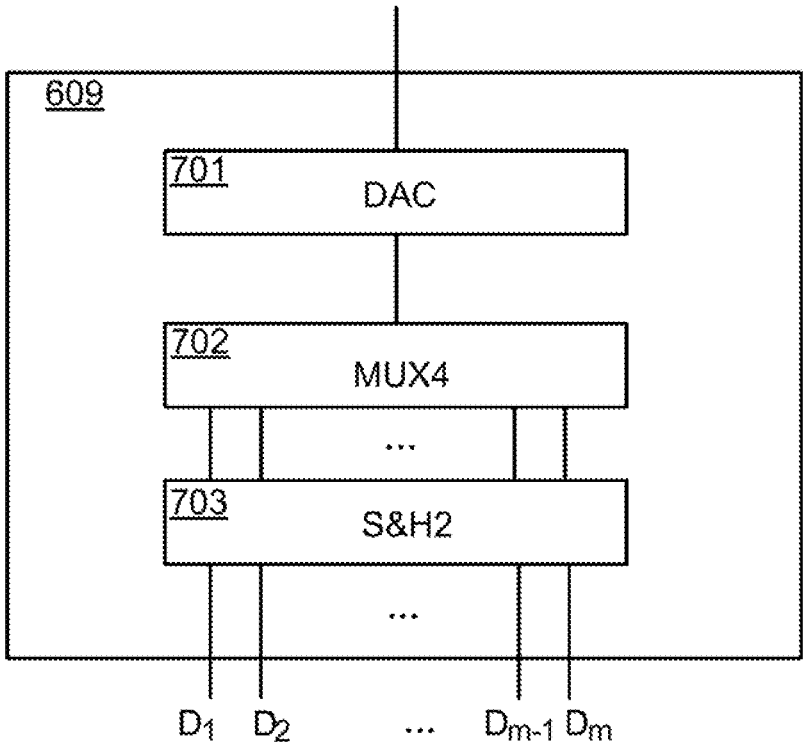
FIG. 7 is a schematic diagram of a data voltage generator according to an embodiment of the present invention.

FIG. 7 is a schematic diagram of a data voltage generator according to an embodiment of the present invention. Referring to FIG. 7, the data voltage generator 609 includes a digital-to-analog converter (DAC) 701, a fourth multiplexer (MUX4) 702, and a second sample-and-hold circuit (S&H2) 703. For each sub-pixel circuit in the pixel array, the DAC 701 is configured to convert the compensation data voltage outputted from the data voltage compensator 608 for the sub-pixel circuit from a digital signal into an analog signal. The fourth multiplexer MUX4 702 has an input connected to an output of the DAC 701 and m selective output ports. The MUX4 702 selects one of m output ports to output the analog signal received from the DAC 701. The S&H2 circuit 703 includes m sample-and-hold channels. Each sample-and-hold channel has an input and an output. The m inputs of the S&H2 circuit 703 respectively connect to m selective output ports of the MUX4 702. The m outputs of the S&H2 circuit 703 respectively connect to m data lines of the pixel array.

For each sample-and-hold channel of the S&H2 circuit 702, when a selective output port of the MUX4 702 connected to the input of the sample-and-hold channel is selected, the input of the sample-and-hold channel receives a compensation data voltage in an analog signal format outputted from the DAC 701 and performs a sampling process to maintain the sampled compensation data voltage thereof.

Figure 8:
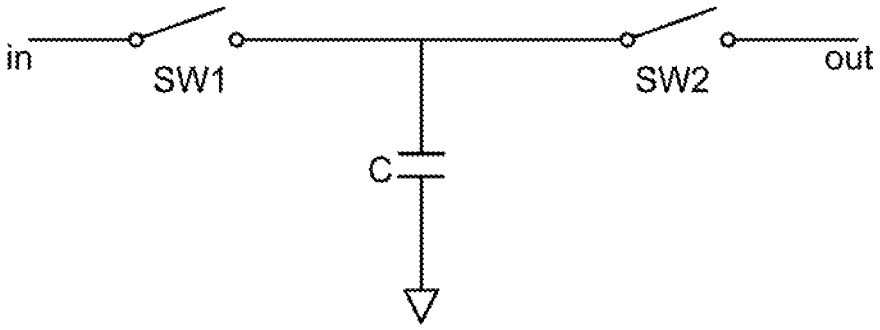
FIG. 8 is a circuitry diagram of a sample-and-hold channel in a sample-and-hold circuit according to an embodiment of the present invention.

FIG. 8 is a circuitry diagram of a sample-and-hold channel in a sample-and-hold circuit according to an embodiment of the present invention. Referring to FIG. 8, a sample-and-hold channel includes an input terminal in, a sampling switch SW1, a maintaining capacitor C, an output switch SW2, and an output terminal out. FIG. 8 is just a simplified example of the sample-and-hold channel though the present invention is not limited thereof.

Figure 9:
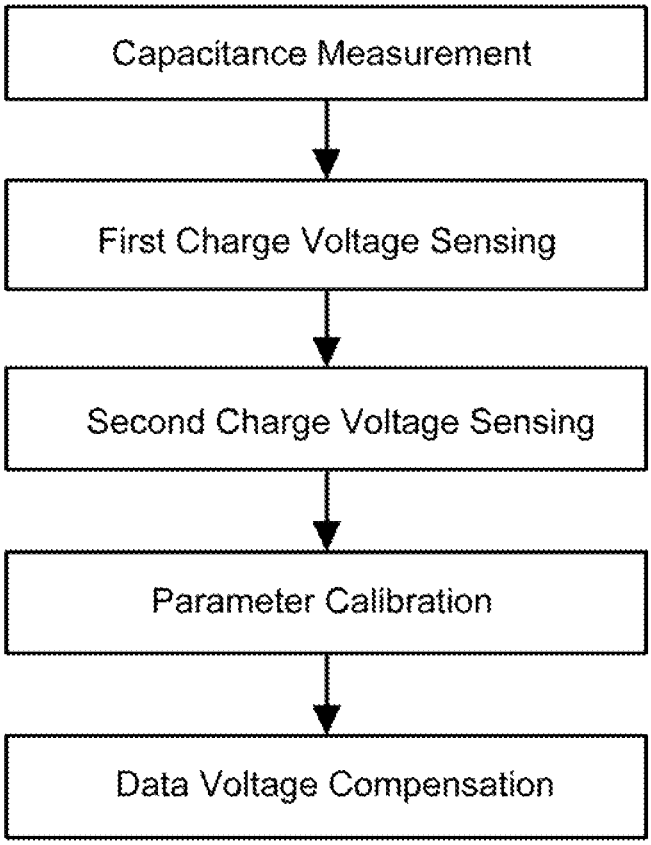
FIG. 9 is a flow chart showing a method for compensating a data voltage from a source electrode driving circuit according to an embodiment of the present invention.

FIG. 9 is a flow chart showing a method for compensating a data voltage from a source electrode driving circuit according to an embodiment of the present invention. In some embodiments, the method is implemented based on the source electrode driving circuit as shown in FIG. 6A and FIG. 6B. Optionally, in a capacitance measurement period, the MUX3 606 (of FIG. 6B) select an output from the capacitance measurement circuit as the source electrode driving circuit is set in a capacitance measurement mode. The MUX1 601 progressively selects each sense line in the pixel array. For each sense line selected by the MUX1 601, the capacitance measurement circuit 603 outputs a capacitance measurement voltage associated with the sense-line capacitance and a pulse voltage provided by a pulse voltage source thereof. Therefore, in this period, a corresponding capacitance measurement voltage associated with respective sense line in the pixel array is obtained. A specific operation can be referred to FIG. 4B, in which each sense line is disconnected from the reference voltage terminal and the second switching transistor in each sub-pixel circuit is in blocking state.

Referring to FIG. 9, in a first charge voltage sensing period, each row of sub-pixel circuits in the pixel array is selected one-after-another. For each currently selected row of sub-pixel circuits, in a first time period, the MUX3 606 is not operated so that all sense lines in the pixel array are connected to respective reference voltage terminals. The data voltage generator 609 progressively outputs a first reference data voltage to each data line of the pixel array. Then in a second time period, the MUX3 606 is not operated as each sense line is disconnected from respective reference voltage terminals. Accordingly, each sense line (with a parasitic capacitor) is charged by the corresponding sub-pixel circuit within the selected row of the sub-pixel circuits. Subsequently in a third time period, the MUX3 606 is operated to select a charge voltage from the output of the MUX2 602 as the source electrode driving circuit is set in a charge sensing mode. The MUX2 602 progressively selects each sense line in the pixel array so that a first charge voltage corresponding to each sub-pixel circuit of the currently selected row of sub-pixel circuits can be read out. A specific operation of the second time period can be referred to FIG. 2 above. Optionally, in the first charge voltage sensing period, the method including progressively select each row of sub-pixel circuits in the pixel array, and performing operations as mentioned above respectively in the first time period, the second time period, and the third time period for each selected row of sub-pixel circuits.

In an example, the operation includes, in the first time period, setting the first scan line G1 to high voltage level, setting the second scan line G2 to high voltage level; in the second time period, setting the first scan line G1 to low voltage level and the second scan line G2 to high voltage level; and in the third time period, setting both the first scan line G1 and the second scan line G2 to low voltage level.

Referring to FIG. 9, in a second charge voltage sensing period, each row of sub-pixel circuits in the pixel array is sequentially selected. For a currently selected row of sub-pixel circuits, the method includes performing operations in a first time period, a second time period, and a third time periods substantially the same as that in the first charge voltage sensing period, except that some different operations are done. The different operation includes, in the first time period, outputting a second reference data voltage by the data voltage generator 609 progressively to each data line; and in the third time period, sequentially reading out a second charge voltage corresponding to each sub-pixel circuit in the selected row of sub-pixel circuits. Specific operations during the second charge voltage sensing period can be referred to FIG. 2.

Referring to FIG. 9 again, in a parameter calibration period, the parameter calibrator 604 is operated to calculate electrical parameters of driving transistor in each sub-pixel circuit (or the selected row) based on the capacitance measurement voltage for each corresponding sense line obtained in the capacitance measurement period, the first charge voltage of each sub-pixel circuit obtained in the first charge voltage sensing period, and the second charge voltage of each sub-pixel circuit obtained in the second charge voltage sensing period. For example, threshold voltage and carrier mobility rate of driving transistor are calculated. Specific operations in this period can be referred to FIG. 6B.

In some embodiments, the method includes executing all the operations in the capacitance measurement period, in the first charge voltage sensing period, in the second charge voltage sensing period, and in the parameter calibration period on a regular basis on the pixel array of the AMOLED display. For example, the method includes executing the operations once every half year, or once every year, or every time when the AMOLED display is starting its operation.

In some embodiments, the method includes storing the electrical parameters of driving transistor for each sub-pixel circuit in the pixel array. In some embodiments, the capacitance measurement period is not necessary before the first charge voltage sensing period and the second charge voltage sensing period, but can be between the first charge voltage sensing period and the second charge voltage sensing period, or can be after the first charge voltage sensing period and the second charge voltage sensing period.

Referring to FIG. 9, in a data voltage compensation period, each row of sub-pixel circuits in the pixel array is sequentially selected. For each sub-pixel circuit in a selected row of sub-pixel circuits, the data voltage compensator 608 is operated to calculate a compensation data voltage of the sub-pixel circuit based on a given data voltage to the sub-pixel circuit and the corresponding electrical parameters of the sub-pixel circuit obtained in the parameter calibration period. Further, the compensation data voltage in analog signal format is generated and outputted to the corresponding data line of the sub-pixel circuit. Specific operations associated with the data voltage compensation period can be referred to FIG. 7.

Based on the calibration apparatus associated with each sub-pixel circuit, the source electrode driving circuit, and the data voltage compensation method provided by the present invention, by measuring the capacitance voltage of the sense line and sensing the charge voltage on the sense-line capacitor under a condition that a reference data voltage is applied to the corresponding data line, relevant electrical parameters and their drifts of driving transistor of each selected sub-pixel circuit can be determined. Further, the data voltage applied to the data line can be adjusted based on the as-determined drifts of the electrical parameters of the driving transistor to make a compensation to the non-uniformity in pixel luminance due to the drifts of the electrical parameters among different sub-pixel circuits.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A source electrode driving circuit configured to generate a data voltage for each corresponding sub-pixel circuit in a pixel array, wherein the pixel array includes, a plurality of sub-pixels, a plurality of first scan lines, a plurality of second scan lines, a plurality of data lines, and a plurality of sense lines, each sub-pixel comprises a sub-pixel circuit including a driving transistor, a first switching transistor, a second switching transistor, and a light emitter, wherein the sense line comprises a parasitic capacitance; the source electrode driving circuit comprising:

a first multiplexer configured to select each sense line in the pixel array;

a capacitance measurement circuit connected to an output terminal of the first multiplexer, the capacitance measurement circuit comprising a pulse voltage source, the capacitance measurement circuit configured to charge the sense line selected by the first multiplexer based on a pulse voltage generated by the pulse voltage source and configured to output a capacitance measurement voltage associated with the pulse voltage and the parasitic capacitance of the sense line selected by the first multiplexer;

a second multiplexer comprises a plurality of input lines configured to select each the sense line selected by the second multiplexer; and a parameter calibrator coupled to the output line of the second multiplexer and configured to calculate electrical parameters of the driving transistor in a sub-pixel circuit corresponding to the sense line selected by the second multiplexer based on the capacitance measurement voltage corresponding to the sense line selected by the second multiplexer, and based on a reference data voltage applied to the data line and the charge voltage to charge the sense line selected by the second multiplexer.

2. The source electrode driving circuit of claim 1, wherein the pixel array includes M rows and N columns of pixels, each pixel includes at least one sub-pixel, each row of sub-pixels share a first scan line and a second scan line, and each column of sub-pixels share a data line and a sense line.

3. The source electrode driving circuit of claim 1, further comprising a third multiplexer configured to, select one of the capacitance measurement voltage received from the capacitance measurement circuit to control the source electrode driving circuit to operate in a capacitance measurement mode and the charge voltage received from the second multiplexer to control the source electrode driving circuit to operate in a charge sensing mode.

4. The source electrode driving circuit of claim 3, further comprising:

an analog-to-digital convertor connected to an output terminal of the third multiplexer to convert an analog signal associated with either the capacitance measurement voltage or the charge voltage to a digital signal;

a data voltage compensator configured to determine a compensation data voltage for each sub-pixel circuit in the pixel array based on a given data voltage applied to the data line of the sub-pixel circuit and the electrical parameters of the driving transistor of the sub-pixel circuit obtained by the parameter calibrator; and a data voltage generator configured to generate and apply the compensation data voltage to the data line connected to the sub-pixel circuit.

5. The source electrode driving circuit of claim 4, wherein the parameter calibrator and the data voltage compensator each comprises a digital signal processor for processing the electrical parameters and the compensation data voltage in digital format.

6. The source electrode driving circuit of claim 4, wherein the data voltage generator comprises a digital-to-analog convertor configured to convert the compensation data voltage in digital format determined by the data voltage compensator to an analog signal and apply the compensation data voltage in analog format to the data line connected to the sub-pixel circuit.

7. The source electrode driving circuit of claim 6, wherein the second multiplexer is configured to output a first charge voltage corresponding to a sense line selected in order by the second multiplexer from a row of sub-pixel circuits selected from the pixel array, each data line connected to the row of sub-pixel circuits being applied with a first reference data voltage;

the second multiplexer is further configured to output a second charge voltage corresponding to a sense line selected in order by the second multiplexer from ,a row of sub-pixel circuits selected from the pixel array, each data line connected to the row of sub-pixel circuits being applied with a second reference data voltage; and the parameter calibrator is configured to determine the electrical parameters of the driving transistor of each sub-pixel circuit in the pixel array based on the capacitance measurement voltage on the sense line connected to the sub-pixel circuit measured by the capacitance measurement circuit, the first reference data voltage applied to the corresponding data line connected to the sub-pixel circuit, the first charge voltage on the corresponding sense line connected to the sub-pixel circuit, the second reference data voltage applied to the corresponding data line, and the second charge voltage on the corresponding sense line, wherein the first reference data voltage and the second reference data voltage are applied to the corresponding data line in different time periods.

8. The source electrode driving circuit of claim 1, wherein the electrical parameters comprise threshold voltage and carder mobility rate associated with a driving transistor in the sub-pixel circuit.

9. The source electrode driving circuit of clam 1, wherein the capacitance measurement circuit comprises:

the pulse voltage source having a first terminal being grounded and a second terminal outputting the pulse voltage;

a voltage comparator having a non-inverting input terminal connected to the second terminal of the pulse voltage source and an inverting input terminal connected to the sense line and an output terminal outputting the capacitance measurement voltage, and a feedback circuit having a first terminal connected to the output terminal of the voltage comparator and a second terminal connected to the inverting input terminal of the voltage comparator.

10. The source electrode driving circuit of claim 9, wherein the feedback circuit comprises a first resistor and a first capacitor having a first common terminal connected to the inverting input terminal of the voltage comparator and a second common terminal connected to the output terminal of the voltage comparator; and the parameter calibrator is configured to determine the electrical parameters of the driving transistor of the sub-pixel circuit corresponding to the sense line selected by the second multiplexer based on the capacitance measurement voltage measured for the sense line by the capacitance measurement circuit and associated pulse voltage, the capacitance of the first capacitor, the reference data voltage applied to the data line connected to the sub-pixel circuit, and the charge voltage to charge the sense line.

11. A method for compensating data voltage applied to each data line of a selected row of sub-pixel circuits driven by a source electrode driving circuit of claim 4, the method comprising:

selecting the capacitance measurement voltage received from the capacitance measurement circuit by the third multiplexer to control the source electrode driving circuit to operate in the capacitance measurement mode, the capacitance measurement voltage being associated with the parasitic capacitance of the sense line selected by the first multiplexer, wherein the first multiplexer sequentially selects each sense line associated with the selected row of sub-pixel circuits;

outputting a first reference data voltage in a first period from the digital voltage generator progressively to one data line after another and obtaining a first charge voltage for each sub-pixel circuit read from a currently charged voltage on the corresponding sense line sequentially selected by the second multiplexer for the selected row of sub-pixel circuits from the pixel array;

outputting a second reference data voltage in a second period from the digital voltage generator progressively to one data line after another and obtaining a second charge voltage for each sub-pixel circuit read from a currently charged voltage on the corresponding sense line sequentially selected by the second multiplexer for the selected row of sub-pixel circuits from the pixel array;

calculating electrical parameters of a driving transistor in each of the selected row of sub-pixel circuits from the pixel array by the parameter calibrator based on the capacitance measurement voltage measured for the corresponding sense line, the first charge voltage and the second charge voltage of each sub-pixel circuit associated with the corresponding sense line obtained respectively in the first time period and the second time period; and determining a compensation data voltage of the sub-pixel circuit by the data voltage compensator based on a given data voltage applied to the corresponding data line of the sub-pixel circuit and the electrical parameters of the driving transistor in the sub-pixel circuit, generating and applying the compensation data voltage to the data line connected to the sub-pixel circuit.

12. The method of claim 11, wherein outputting a first reference data voltage to each data line and obtaining a first charge voltage from each corresponding sense line further comprise:

connecting the sense line in the pixel array to a reference voltage terminal as the first reference data voltage being progressively outputted to each corresponding data line;

disconnecting the sense line being charged by the sub-pixel circuit from the reference voltage terminal;

sequentially selecting each sense line by the second multiplexer and reading a charged voltage currently on the sense line as an output; and selecting the output by the third multiplexer during the charge sensing mode and outputting the output as the first charge voltage.

13. The method of claim 11, wherein outputting a second reference data voltage to each data line and obtaining a second charge voltage from each corresponding sense line further comprise:

connecting the sense line in the pixel array to a reference voltage terminal as the second reference data voltage is progressively outputted to each corresponding data line;

disconnecting the sense line being charged by the sub-pixel circuit from the reference voltage terminal;

sequentially selecting each sense line by the second multiplexer and reading a charged voltage currently on the sense line as an output; and selecting the output by the third multiplexer during the charge sensing mode and outputting the output as the second charge voltage.

14. The method of claim 11, wherein determining a compensation data voltage of the sub-pixel circuit comprises processing digital signals associated with the given data voltage applied to the data line of the sub-pixel circuit and corresponding electrical parameters of the driving transistor in the sub-pixel circuit to calculate a digital voltage signal, convening the digital voltage signal to an analog voltage signal by the data voltage generator, outputting the analog voltage signal as a compensation data voltage to the data line of the sub-pixel circuit.

15. The method of claim 11, wherein the electrical parameters of the driving transistor include threshold voltage and carrier mobility rate associated with the driving transistor in the sub-pixel circuit.

* * * * *